US010167877B2

(12) United States Patent
Ibaraki et al.

(10) Patent No.: US 10,167,877 B2
(45) Date of Patent: Jan. 1, 2019

(54) CENTRIFUGAL COMPRESSOR

(71) Applicant: MITSUBISHI HEAVY INDUSTRIES, LTD., Tokyo (JP)

(72) Inventors: Seiichi Ibaraki, Tokyo (JP); Isao Tomita, Tokyo (JP); Hiroshi Suzuki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 292 days.

(21) Appl. No.: 14/762,138

(22) PCT Filed: Feb. 22, 2013

(86) PCT No.: PCT/JP2013/054566

§ 371 (c)(1),
(2) Date: Jul. 20, 2015

(87) PCT Pub. No.: WO2014/128931

PCT Pub. Date: Aug. 28, 2014

(65) Prior Publication Data

US 2015/0354591 A1 Dec. 10, 2015

(51) Int. Cl.
*F04D 29/48* (2006.01)
*F04D 17/10* (2006.01)
(Continued)

(52) U.S. Cl.
CPC ..... *F04D 29/464* (2013.01); *F04D 17/10* (2013.01); *F04D 27/0253* (2013.01);
(Continued)

(58) Field of Classification Search
CPC .... F04D 29/464; F04D 17/10; F04D 27/0253; F04D 29/4206
(Continued)

(56) References Cited

U.S. PATENT DOCUMENTS 2,204,169 A * 6/1940 Zerkowitz ..... F25B 9/004 415/135
3,237,564 A * 3/1966 Hartland ..... F03B 3/183 100/901
(Continued)

FOREIGN PATENT DOCUMENTS

CN 1070721 A 4/1993
DE 102010026176 A1 1/2012
(Continued)

OTHER PUBLICATIONS

International Preliminary Report on Patentability and Written Opinion of the International Searching Authority (Forms PCT/IB/326, PCT/IB/373, PCT/ISA/237 and PCT/IB/338) for International Application No. PCT/JP2013/054566, dated Sep. 3, 2015, with an English translation.
(Continued)

*Primary Examiner* — Mark Laurenzi
*Assistant Examiner* — Deming Wan
(74) *Attorney, Agent, or Firm* — Birch, Stewart, Kolasch & Birch, LLP

(57) ABSTRACT

An object of the present invention is to decrease a surging limit flow rate at a low flow rate time, by increasing the inflow velocity to the blade of the impeller wheel, by providing a resistive element that narrows in the radial direction a passage cross section of an air intake passage which communicates between a impeller wheel of a centrifugal compressor and an air intake opening.
The centrifugal compressor includes: the compressor housing 9 having the air intake opening 13 opened in a rotary shaft direction, and the air intake passage 11; and the impeller wheel 7 for compressing the air flowing in from the air intake opening 13, inside the housing. The resistive elements 27 and 43 against the air intake flow are provided in either the inner peripheral wall 23 side portion or the
(Continued)

center side portion of the air intake passage 11, so that, at the low flow rate time, a cross-sectional area of the air intake passage 11 is narrowed by the resistive elements 27 and 43 thereby increasing the inflow velocity to the blade 19 of the impeller wheel, and the intake air flow is biased to the hub side of the blade 19, and the intake air flow is biased to flow to the hub side or the shroud side of the blade 19.

3 Claims, 10 Drawing Sheets

(51) Int. Cl.
*F04D 27/02* (2006.01)
*F04D 29/42* (2006.01)
*F04D 29/46* (2006.01)
*F04D 29/44* (2006.01)

(52) U.S. Cl.
CPC ..... *F04D 29/4206* (2013.01); *F04D 29/4213* (2013.01); *F04D 29/441* (2013.01); *F05D 2250/51* (2013.01)

(58) Field of Classification Search
USPC ..... 415/151, 167, 159, 148, 219.1; 60/607–609
See application file for complete search history.

(56) References Cited

U.S. PATENT DOCUMENTS

| | | | | |
|---|---|---|---|---|
| 3,741,677 | A | 6/1973 | Silvern et al. | |
| 3,922,108 | A * | 11/1975 | Benisek | F02B 37/225 415/116 |
| 9,850,913 | B2 * | 12/2017 | An | F04D 29/4213 |
| 2004/0009061 | A1 | 1/2004 | McDonald | |

FOREIGN PATENT DOCUMENTS

| | | | |
|---|---|---|---|
| GB | 957884 | A | 5/1964 |
| JP | 51-81001 | A | 7/1976 |
| JP | 54-119103 | A | 9/1979 |
| JP | 55-142998 | A | 11/1980 |
| JP | 60-195997 | U | 12/1985 |
| JP | 62-143097 | U | 9/1987 |
| JP | 3-20560 | Y | 5/1991 |
| JP | 2003-120594 | A | 4/2003 |
| JP | 2004-27931 | A | 1/2004 |
| JP | 2004-44576 | A | 2/2004 |
| JP | 2004-278386 | A | 10/2004 |
| JP | 2006-63961 | A | 3/2006 |
| JP | 2006-112323 | A | 4/2006 |
| JP | 2007-77860 | A | 3/2007 |
| JP | 2007-127109 | A | 5/2007 |
| JP | 2009-236035 | A | 10/2009 |
| JP | 2010-65669 | A | 3/2010 |
| JP | 2010-71140 | A | 4/2010 |
| JP | 2010-138765 | A | 6/2010 |
| JP | 2012-184751 | A | 9/2012 |

OTHER PUBLICATIONS

International Search Report and Written Opinion of the International Searching Authority (Forms PCT/ISA/210, PCT/ISA/220 and PCT/ISA/237) for International Application No. PCT/JP2013/054566, dated May 7, 2013.
Office Action effective Aug. 2, 2016 issued in the corresponding Chinese Application No. 201380070927.6 with English Translation.
Extended European Search Report dated Jun. 28, 2016, for European Application No. 13875801.6.
Office Action dated Sep. 2, 2016 issued in the corresponding Japanese Application No. 2015-501196 with an English Translation.
Partial Supplementary European Search Report effective Feb. 3, 2016 issued in corresponding EP Application No. 13875801.6.
Office Action effective Aug. 29, 2017 issued to the corresponding JP Application No. 2016-214301 with an English Machine Translation.
Chinese Office Action and Search Report, dated Jun. 27, 2018 for Chinese Application No. 201611175028.4, with an English machine translation of the Chinese Office Action.

* cited by examiner

AT HIGH FLOW RATE TIME

AT LOW FLOW RATE TIME

CENTRIFUGAL COMPRESSOR

TECHNICAL FIELD

The present invention relates to a centrifugal compressor equipped with an impeller wheel that rotates by a rotary shaft, and relates particularly to a centrifugal compressor built in an exhaust turbocharger.

BACKGROUND

In engines used for automobiles and the like, there has been widely known an exhaust turbocharger that rotates the turbine with energy of the exhaust gas of the engine in order to improve the output of the engine, and supplies to the engine the intake air by compressing the intake air by a centrifugal compressor directly coupled to the turbine via a rotary shaft.

The centrifugal compressor used for the exhaust turbocharger requires a wide operating range. When the flow rate of the centrifugal compressor decreases, an unstable phenomenon called surging occurs, and when the flow rate increases, choking occurs in the impeller or the diffuser, so that the flow rate range is limited.

In order to expand the operating range of a centrifugal compressor, there is a case of applying a casing treatment for providing a groove and a circulation passage in the casing. Although the operating range is enlarged by this application, substantial improvement cannot be expected.

Also, there is a case of expanding the operating range by applying a variable mechanism such as an entrance variable guide vane and a variable diffuser in the centrifugal compressor.

In the variable diffuser, the operating range can be significantly expanded by making a passage area variable by rotating and sliding the diffuser vane, as compared with the casing treatment.

However, in this case, a complicated drive mechanism is necessary, and the drive mechanism is costly. Moreover, there are problems in the reliability of a sliding part, a reduction in the performance due to a gap in the sliding part, gas leakage, and the like.

As prior art techniques of providing a circulation passage in the casing as one of techniques of expanding the operating range of the centrifugal compressor, there have been known Patent Document 1 (Japanese Unexamined Patent Publication No. 2007-127109) and Patent Document 2 (Japanese Unexamined Patent Publication No. 2004-27931).

Patent Document 1 discloses a technique of providing a recirculation passage by inclining an air flow out center line from an exit slit to the entrance air passage, at a certain angle toward the impeller, in the compressor that takes in a part of air from an entrance slit opened to the impeller outer peripheral air passage and takes out the intake air from the exit slit to the entrance air passage through the recirculation passage.

Also, Patent Document 2 discloses a technique of providing a circulation flow path for communicating an air entrance part to an impeller and a shroud part of the impeller, and providing an opening position on the shroud part of the circulation flow path, at a predetermined position along the meridian from a front edge of the blade.

Further, as a prior art technique of providing a variable vane to the diffuser part which is one of the expanding techniques of the operating range of the centrifugal compressor, there has been known Patent Document 3 (Japanese Unexamined Patent Publication No. 2010-65669). Patent Document 3 discloses a technique of providing a flow rate adjusting valve in either one of flow paths of a diffuser part obtained by dividing the flow path of the diffuser part.

CITATION LIST

Patent Literature

Patent Document 1: Japanese Unexamined Patent Publication No. 2007-127109

Patent Document 2: Japanese Unexamined Patent Publication No. 2004-27931

Patent Document 3: Japanese Unexamined Patent Publication No. 2010-65669

SUMMARY

Technical Problem

However, although the improvement by providing a circulation passage as described in Patent Documents 1 and 2 works to improve the surging at a low flow rate time and slightly enlarges the operating range, substantial improvement cannot be expected.

Further, the improvement by providing a flow rate adjusting valve in the diffuser part requires a drive mechanism of the flow adjusting valve and incurs a cost increase, and substantial improvement in the operating range on a low flow rate side cannot be expected.

Therefore, further improvement on the low flow rate side was necessary.

In view of the above technical problems, an object of the present invention is to decrease a surging limit flow rate at a low flow rate time, by increasing the inflow velocity to the blade of the impeller wheel, by providing a resistive element that narrows in the radial direction a passage cross section of an air intake passage which communicates between a impeller wheel of a centrifugal compressor and an air intake opening.

Solution to Problem

In order to achieve the above object, the present invention provides a centrifugal compressor including: a housing having an air intake opening opened in a rotary shaft direction, and an air intake passage continuous to the air intake opening; and an impeller wheel rotationally disposed centered around the rotary shaft inside the housing, the centrifugal compressor compressing an intake air flowing in from the air intake opening. A resistive element against an air intake flow is provided in either an inner peripheral wall side portion or a center side portion of the air intake passage, so that, at a low flow rate time, a cross-sectional area of the air intake passage is narrowed by the resistive element thereby increasing an inflow velocity to a blade of the impeller wheel, and intake air is biased to a hub side of the blade by an inner peripheral resistive element provided on the inner peripheral wall side portion of the air intake passage, and intake air is biased to flow to a shroud side of the blade by a center resistive element provided on the center side portion.

According to the present invention, because the resistive element is provided against the intake air flow inside the air intake passage, the inflow velocity to the blade front edge of the impeller wheel is increased by narrowing the sectional area of the air intake passage, as compared with the case where there is no resistive element.

At a high flow rate time, the bias of the flow due to the influence of the resistive element is small as compared with that at a low flow rate time, and air flows in to a total area from a hub side to the shroud side front end in the height direction of the blade front edge. Following the decrease in the flow rate, at a low flow rate time, the inflow velocity to the blade of the impeller wheel is increased by the resistive element, and the intake air can be biased to the hub side of the blade by the inner peripheral resistive element provided on the inner peripheral wall side portion of the air intake passage, or the intake air can be biased to the shroud side of the blade by the center resistive element provided on the center side portion.

Accordingly, at the low flow rate time, that is, in the low flow rate area where a surging phenomenon occurs, the air inflow velocity to the blade increases, and the surging limit flow rate can be decreased by suppressing the stall of the impeller wheel.

Also, by the inner peripheral resistive element, the intake air flow is allowed to flow in to the hub side of the blade by biasing, and by the center resistive element, the intake air flow is allowed to flow in to the shroud side of the blade by biasing. As a result, a using state similar to the state of using a small blade is obtained, and reduction in the performance (a pressure rate) can be suppressed even at a low flow rate.

Preferably, in the present invention, the inner peripheral resistive element is formed in a ring shape, and includes a guide unit provided on an inner peripheral end of the inner peripheral resistive element, the guide unit formed in a cylindrical shape extending in an axial direction of the air intake passage, or in a hollow truncated cone shape in which a flow path on an inflow side is wide and a flow path on an outflow side is narrowed, or in a bell-mouth shape.

As described above, because the guide member is formed in a cylindrical shape extending in an axial direction of the air intake passage, or in a hollow truncated cone shape in which a flow path on an inflow side is wide and a flow path on an outflow side is narrowed, or in a bell-mouth shape, directivity of the intake air flowing in the center portion of the air intake passage is stabilized, and the flow to the hub side of the front edge of the blade at the low flow rate time can be securely formed. Further, by widening the entrance part and by narrowing the outflow part in this way, the increase effect of the inflow velocity to the blade can be also expected.

Further, preferably, in the present invention, the inner peripheral resistive element is installed at a portion of a height equal to or larger than about 50% of a height of a front edge of the blade.

As described above, the inner peripheral resistive element is installed in the area of a height equal to or larger than about 50% of the height of the front edge of the blade. When the inner peripheral resistive element exists in the area equal to or smaller than 50% by protruding to the inner diameter side, there is a risk of being unable to secure a necessary flow rate due to the increase in the flow path resistance at a high flow rate time. Therefore, such a performance aggravation is prevented.

Further, preferably, in the present invention, the center resistive element is formed in a disk shape, and includes a guide unit covering an outer periphery of a disk of the center resistive element, the guide unit formed in a cylindrical shape extending in an axial direction of the air intake passage, or in a hollow truncated cone shape in which a flow path on an inflow side is wide and a flow path on an outflow side is narrowed, or in a bell-mouth shape.

As described above, the center resistive element is provided on the inner side of the guide unit, and the guide unit is provided on the outer side of the center resistive element. Therefore, directivity of the intake air flowing near the inner peripheral wall of the air intake passage is stabilized, and the flow to the shroud side of the front edge of the blade at the low flow rate time can be securely formed.

Further, preferably, in the present invention, the center resistive element is installed in a height equal to or smaller than about 50% of a height of a front edge of the blade.

As described above, the center resistive element is installed in the area of a height equal to or smaller than about 50% of the height of the front edge of the blade. When the center resistive element exists in the area exceeding 50% of the height of the front edge, there is a risk of being unable to secure a necessary flow rate due to the increase in the flow path resistance at a high flow rate time. Therefore, such a performance aggravation is prevented.

Further, preferably, in the present invention, the center resistive element of the disk shape includes an openable and closable valve element rotating between a total opening along an intake air flow and a total closing interrupting the intake air flow, using a radial direction of the air intake passage as a rotational center axis.

As described above, the center resistive element is configured by an openable and closable valve element rotating between a total opening along an intake air flow and a total closing which bocks the intake air flow, using a radial direction of the air intake passage as a rotational center axis. Therefore, depending on the state of the intake air flow rate, at the time of the low flow rate state, in order to prevent the surging, the valve element can be controlled to be closed to increase the inflow speed, and the bias to the shroud side of the blade is enhanced. At the high flow rate time, the valve element can be controlled to be opened to secure the flow rate.

Specifically, the valve element may be controlled to be in the total opening state when the intake air flow rate is equal to or higher than a predetermined value, and the valve element may be controlled to be closed along the decrease in the flow rate.

As described above, following the decrease in the flow rate, the valve element is closed so that air flows in to the shroud side to increase the flow velocity. As compared with the state that the valve element is opened, the inflow velocity of the air to the blade increases, and the surging limit flow rate can be decreased by suppressing the stall of the turbine wheel.

Further, preferably, in the present invention, the valve element is configured by a resistive element including a slit-shaped or meshed member.

As described above, because the valve element is configured by a resistive element including a slit-shaped or meshed member, a flow also occurs on the hub side when the valve element is at the total opening time. As a result, a flow separation at the downstream of the valve element is reduced and performance improves.

Further, preferably, in the present invention, the inner peripheral resistive element and the center resistive element are configured by a porous plate, or a slit-shaped or meshed member.

Instead of adjusting the narrowing range by opening and closing the valve element, a flow rate at the high flow rate time can be secured and the occurrence of surging at the low flow rate time can be prevented, by a simple structure without using the valve opening and closing mechanism, by using a porous plate or a meshed plate having a constant air permeability (diaphragm rate).

Further, preferably, in the present invention, the inner peripheral resistive element is formed by a ring-shaped protruded member convex to an inner diameter side of an inner peripheral wall of the air intake passage, and includes a movable unit that protrudes a convex portion of the ring-shaped protruded member to an inner diameter side of the air intake opening when an inflow air intake amount is at a low flow rate.

As described above, the inner peripheral resistive element is formed by a ring-shaped protruded member convex to an inner diameter side of an inner peripheral wall of the air intake passage, and the inner peripheral resistive element includes a movable unit that protrudes a convex portion of the ring-shaped protruded member to an inner diameter side of the air intake opening when an inflow air intake amount is at a low flow rate. Therefore, following the decrease in the flow rate, the convex portion is formed on the shroud side, and the air starts flowing in to the hub side due to the influence of the formation. As a result, as compared with the case where there is no convex portion, the inflow velocity to the blade increases, and the surging limit flow rate can be decreased by suppressing the stall of the blade.

Advantageous Effects

According to the present invention, a surging limit flow rate at a low flow rate time can be decreased, by providing a resistive element that narrows in the radial direction a passage cross section of an air intake passage which communicates between a impeller wheel of a centrifugal compressor and an air intake opening.

BRIEF DESCRIPTION OF DRAWINGS

FIG. 2A illustrates a distribution at a high flow rate time; and FIG. 2B illustrates a distribution at a small distribution rate time.

FIG. 6 is an explanatory view illustrating a flow velocity distribution at a blade entrance part according to the second embodiment.

DETAILED DESCRIPTION

Embodiments of the present invention will be described in detail below with reference to the accompanying drawings. Sizes, materials, shapes, relative arrangement and the like of configuration parts described in the following embodiments are not intended to limit the scope of the present invention and are only description examples except where specifically described.

Figure 1:
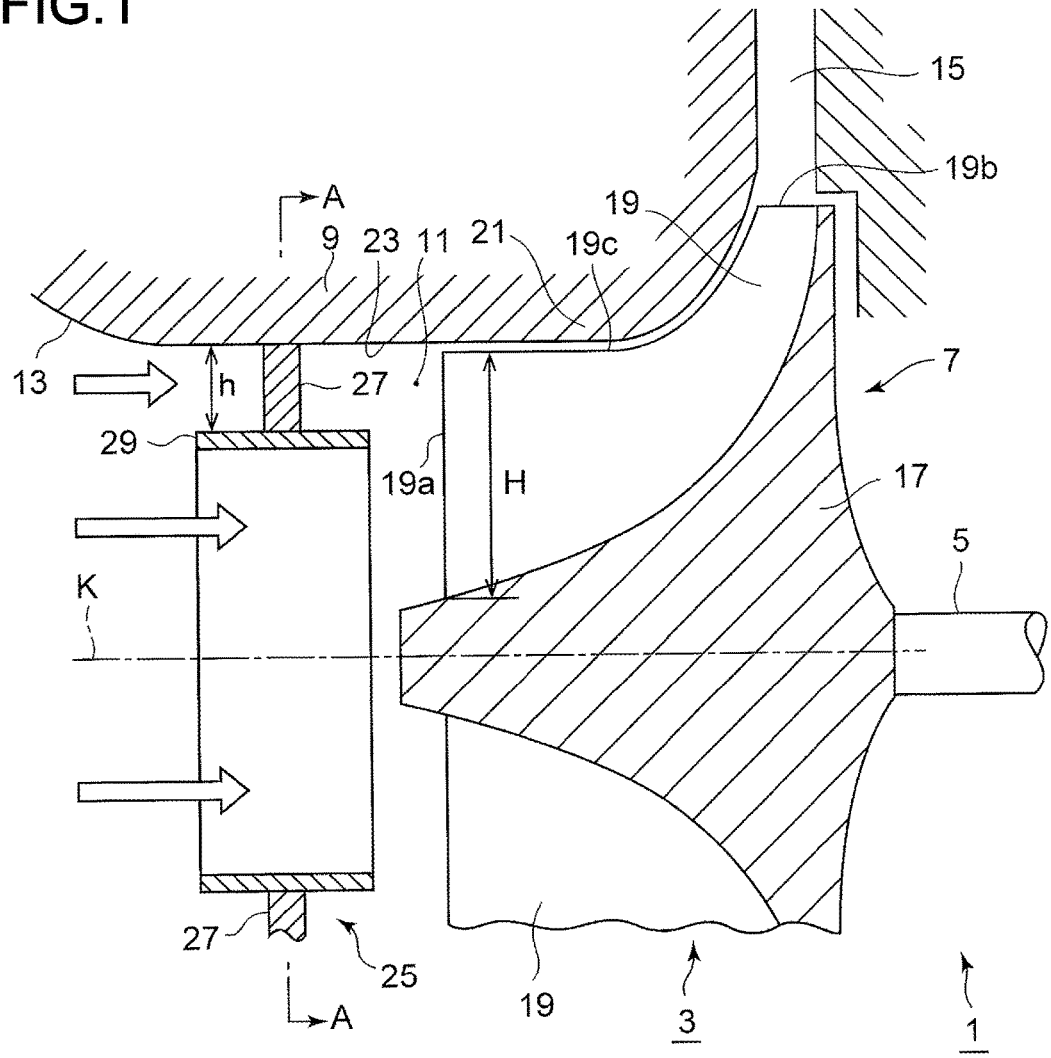
FIG. 1 is a sectional view of a main part in a rotary shaft direction of a centrifugal compressor according to a first embodiment of the present invention.

FIG. 1 illustrates a sectional view of main parts in a rotary axis line K direction of a compressor (centrifugal compressor) 3 used in an exhaust turbocharger of an internal combustion engine, and mainly illustrates an upper half portion.

The exhaust turbocharger 1 is arranged such that rotational force of a turbine rotor driven by exhaust gas of the internal combustion engine not illustrated is transmitted to an impeller wheel 7.

The centrifugal compressor 3 has the impeller wheel 7 supported rotatably around the rotary axis line K of the rotary shaft 5 in a compressor housing 9. An air intake passage 11 leading the intake gas before being compressed, air for example, to the impeller wheel 7 extends concentrically with the rotary axis line K and in a cylindrical shape. An air intake opening 13 continuous to the air intake passage 11 is opened to an end part of the air intake passage 11. The air intake opening 13 is enlarged in a tapered shape toward the end part for easy introduction of air.

A diffuser 15 extending in a direction at a right angle with the rotary axis line K is formed on the outer side of the impeller wheel 7, and a spiral air passage not illustrated is provided on the outer periphery of the diffuser 15. The spiral air passage forms an outer peripheral portion of the compressor housing 9.

The impeller wheel 7 has a hub part 17 rotationally driven around the rotary axis line K, and a plurality of vanes (blades) 19 provided on the outer peripheral surface of the hub part 17. The hub part 17 is mounted on the rotary shaft 5, and a plurality of vanes 19 are adapted to be rotationally driven together with the hub part 17.

Each vane 19 is rotationally driven so as to absorb the air from the air intake opening 13 and compress the air passed through the air intake passage 11, and a shape of the vane 19 is not particularly limited. The vane 19 includes a front edge 19*a* as an edge part on the upstream side, a rear edge 19*b* as an edge part on the downstream side, and an outer peripheral edge (an outer peripheral part) 19*c* as an edge part on the outer side in the radial direction. The outer peripheral edge 19*c* refers to a portion of a side edge covered by a shroud part 21 of the compressor housing 9. The outer peripheral edge 19*c* is arranged to pass near the inner surface of the shroud part 21.

The impeller wheel 7 of the compressor 3 is rotationally driven by the rotary shaft rotated by the rotary drive force of the turbine rotor not illustrated. Outer air is pulled in the rotary axis line K direction from the air intake opening 13, and flows between the plurality of vanes 19 of the impeller wheel 7. Mainly after a dynamic pressure is increased, the air flows into the diffuser 15 arranged on the outer side in the radial direction. A part of the dynamic pressure is converted to a static pressure and the pressure is increased, and the air is discharged through the spiral air passage formed on the outer peripheral side. The air is then supplied as the intake air of the internal combustion engine.

First Embodiment

A first embodiment will be described with reference to FIG. 1 to FIG. 4B.

In the first embodiment, an inner peripheral resistive element 25 configuring a resistive element against the intake air flow is provided on an inner peripheral wall 23 of the air intake passage 11.

The inner peripheral resistive element 25 is provided on the inner peripheral wall 23 between the air intake opening 13 of the air intake passage 11 and the vane 19, and is formed by a ring-shaped plate member 27. The outer peripheral end part of the plate member 27 is mounted on the inner peripheral wall 23 of the air intake passage 11, and a cylindrical guide unit 29 extending in the axial direction of the air intake passage 11 is mounted on the inner peripheral end part.

A center line of the guide unit 29 coincides with the rotary axis line K, and the guide unit is formed at the center portion of the air intake passage 11, so that the directivity of the intake air flowing in the center portion of the air intake passage 11 is stabilized, and the flow to the hub side of the front edge of the vane 19 at the low flow rate time can be securely formed.

Figure 3:
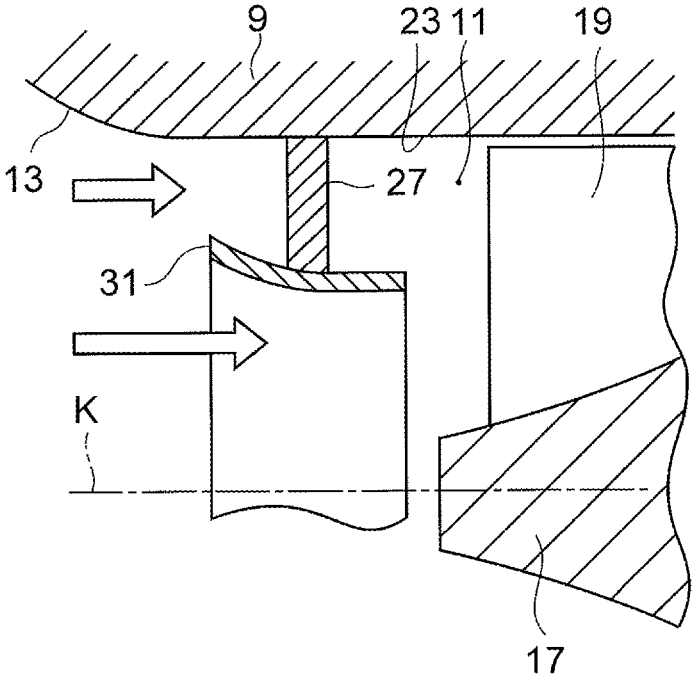
FIG. 3 is a sectional view illustrating other example of a guide part.

In place of the cylindrical shape of the guide unit 29, there may be provided a hollow truncated cone shape in which a flow path on the inflow side is wide and a flow path on the outflow side is narrowed, or a bell-mouth guide unit 31 in a bell-mouth shape, as illustrated in FIG. 3. By expanding the entrance part and by narrowing the outflow part in this way, the effect of increasing the inflow velocity to the entrance of the vane 19 can be also expected.

Figure 4A:
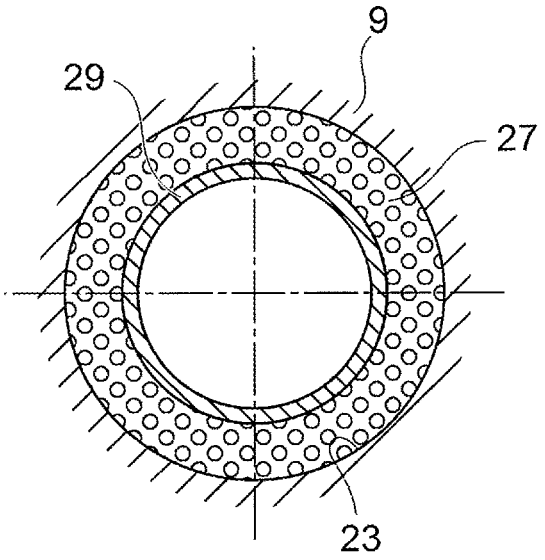
FIG. 4A is an explanatory view of an inner peripheral resistive element according to the first embodiment, and is a sectional view along A-A in FIG. 1.
Figure 4B:
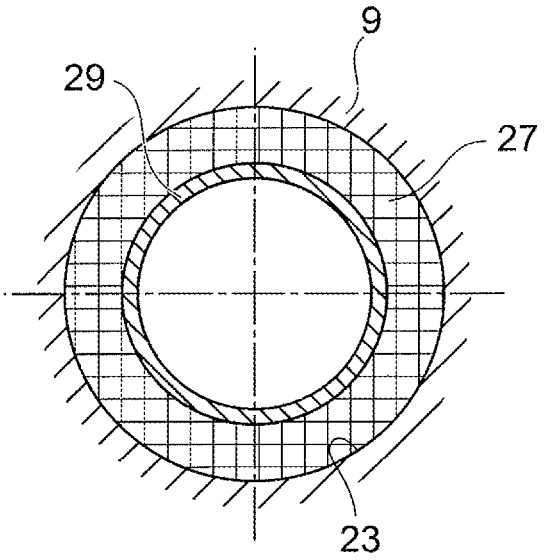
FIG. 4B is an explanatory view illustrating a modification of the inner peripheral resistive element.

Specifically, as illustrated in FIG. 4A and FIG. 4B, it is desirable that, instead of a plate member that entirely interrupts the flow, the plate member 27 is a porous plate or is formed in a lattice (slit) shape or meshed, having the opening set to a predetermined aperture ratio, such as about a half (40% to 60%), or having a pressure loss coefficient set to about 0.4 or lower, for example.

Alternatively, the plate member 27 may be a ring-shaped spongy integrated structure not in a plate shape, or a member having a function as a resistive element against the intake air flow.

When the aperture ratio is lower than the predetermined value or when the pressure loss coefficient is higher than the about 0.4, the intake air flow rate at the high flow rate time cannot be secured, and the performance as the compressor 3 is aggravated. On the contrary, when the aperture ratio is too high or when the pressure loss coefficient is too low, the function as the resistive element cannot be obtained.

Further, as illustrated in FIG. 1, a height h in the radial direction of the ring-shaped plate member 27 is set to a portion of the height equal to or larger than about 50% of a height H of the front edge of the vane 19. That is, the ring-shaped plate member 27 is provided on the inner peripheral wall 23 side of the air intake passage 11. Concerning the height h, when the inner peripheral element 25 exists by protruding to the inner peripheral side in the area less than about 50% of the height of the front edge of the vane 19, there is a risk of increase in the flow path resistance at a high flow rate time and inability to secure a necessary flow rate. Therefore, the height h prevents such performance aggravation.

Next, a flow velocity distribution of the inflow air to the vane 19 based on the installation of the plate member 27 will be described with reference to FIG. 2A and FIG. 2B.

Figure 2A:
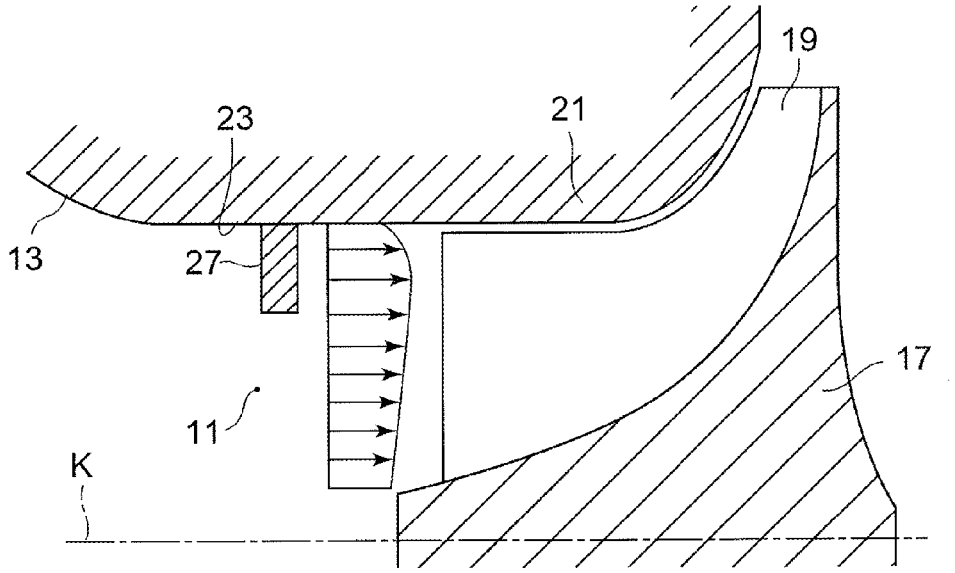
FIGS. 2A and 2B are explanatory views illustrating a flow velocity distribution at a blade entrance part according to the first embodiment.
Figure 2B:
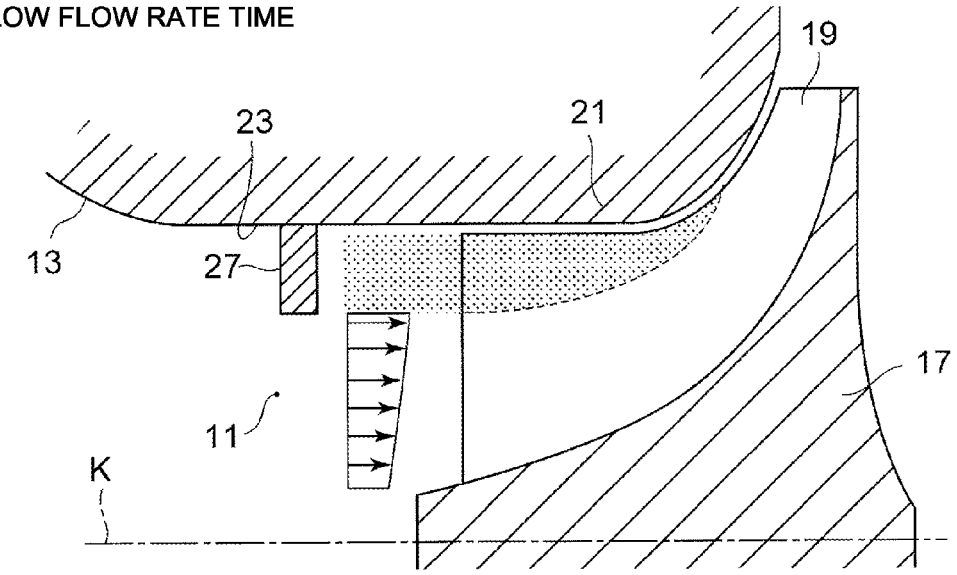

FIG. 2A illustrates a flow velocity distribution at a high flow rate time. At this time, at the entrance of the impeller wheel 7, the air flows from the hub side to the shroud side front end in the blade height direction. Following the decrease in the flow rate, as illustrated in FIG. 2B, the air starts flowing in biased to the hub side due to the influence of the plate member 27 as the resistive element on the shroud side. As compared with the case where there is no resistive element, the inflow velocity of air to the impeller wheel 7 increases, and the surging limit flow rate can be decreased by suppressing the stall of the impeller wheel 7.

Further, at the low flow rate time, by allowing a biased flow to the intake air so that the air flows in to the hub side, the air does not flow to the front end portion of the vane, that is, the air does not flow to the shroud side. As a result, a using state becomes similar to the state of using a small vane, and the low flow rate can be coped with without incurring reduction in the performance of the compressor.

As described above, according to the first embodiment, at the high flow rate time, even when the inner peripheral resistive element 25 exists, the bias of the intake air flow is small as compared with that at the low flow rate time, and the air flows from the hub side to the shroud side front end in the direction of the blade height of the front edge of the vane 19. However, following the decrease in the flow rate, the intake air is biased to the hub side of the vane 19 by the inner peripheral resistive element 25, and also the sectional area of the air intake passage 11 is narrowed. As a result, the flow velocity is increased, and the surging limit flow rate can be decreased without incurring performance reduction.

Second Embodiment

Next, a second embodiment will be described with reference to FIG. 5 to FIG. 7B.

In the second embodiment, a center resistive element 41 configuring a resistive element against the intake air flow is provided in the center portion of the air intake passage 11.

The center resistive element 41 is provided around the rotary axis line K, between the air intake opening 13 of the air intake passage 11 and the vane 19, and is configured by a disk-shaped plate member 43.

A cylindrical guide unit 45 extending in the axis direction of the air intake passage 11 is provided so as to cover the outer periphery of the plate member 43. The outer peripheral part of the guide unit 45 is mounted on the inner peripheral wall 23 of the air intake passage 11 by struts 47 provided at four positions in the peripheral direction.

By providing the center resistive element 41 on the inner side of the guide unit 45 in this way, directivity of the intake air flowing in the center portion of the air intake passage 11 can be stabilized by the guide unit 45. Further, by providing the guide unit 45, directivity of the intake air flowing near the inner peripheral wall of the air intake passage 11 is stabilized, and the flow to the shroud side of the front edge 19*a* of the vane 19 at the low flow rate time can be securely formed.

In place of the cylindrical shape of the guide unit 45, there may be provided a hollow truncated cone shape in which a flow path on the inflow side is wide and a flow path on the outflow side is narrowed, or the bell-mouth guide unit 31 in a bell-mouth shape, as illustrated in the first embodiment (FIG. 3). By expanding the entrance part and by narrowing the outflow part in this way, the effect of increasing the inflow velocity to the entrance of the vane 19 can be also expected.

Figure 7A:
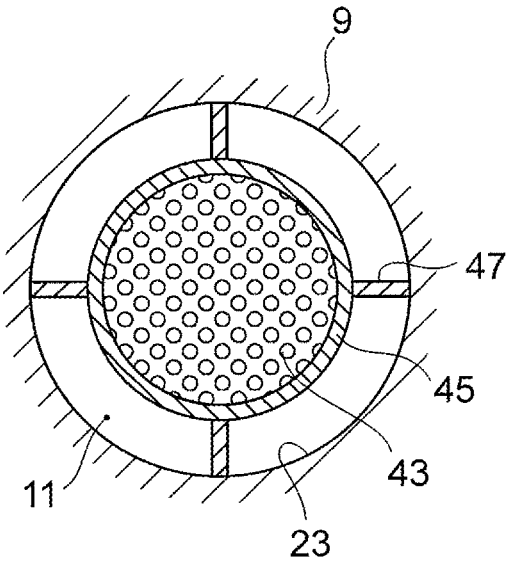
FIG. 7A is an explanatory view of a center resistive element according to the second embodiment, and is a sectional view along B-BA in FIG. 5.
Figure 7B:
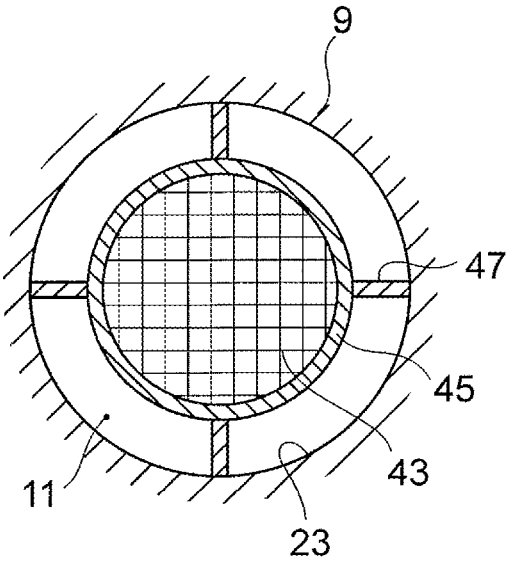
FIG. 7B is an explanatory view illustrating a modification of the center resistive element.

In the manner as described in the first embodiment, it is desirable that, as illustrated in FIG. 7A and FIG. 7B, instead of a plate member that entirely interrupts the flow, the plate member 43 is a porous plate or is formed in a lattice (slit) shape or meshed, having the opening set to a predetermined aperture ratio, such as about a half (40% to 60%), or having a pressure loss coefficient set to about 0.4 or lower, for example. Alternatively, the plate member 43 may be spongy instead of in a disk shape, and it is sufficient when the plate member 43 functions as a resistive element against the intake air flow.

Sizes of the aperture ratio and the pressure loss coefficient are set in the relationship with aggravation of the performance of the compressor 3 in a similar manner to that in the first embodiment.

Figure 5:
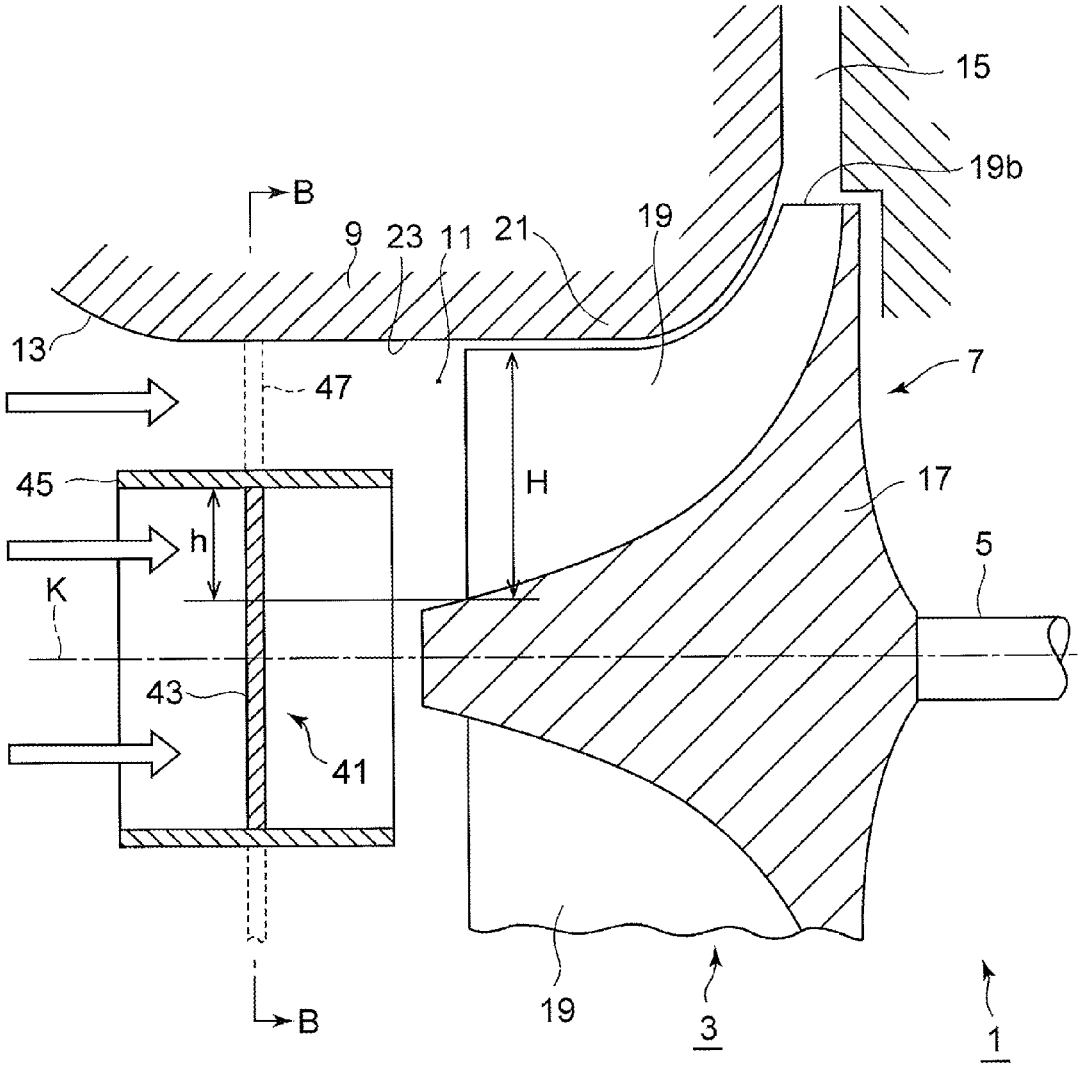
FIG. 5 is a sectional view of a main part in a rotary shaft direction of a centrifugal compressor according to a second embodiment of the present invention.

As illustrated in FIG. 5, the height h in the radial direction of the plate member 43 is set equal to or smaller than about 50% of the height H of the front edge blade of the vane 19. That is, the plate member 43 is provided in the center portion of the air intake passage 11. Concerning the height h, when the plate member 43 exists in the area exceeding about 50% of the height of the front edge of the vane 19, there is a risk of increase in the flow path resistance at the high flow rate time and inability to secure a necessary flow rate. Therefore, the height h prevents such performance aggravation.

Next, a flow velocity distribution of the inflow air to the vane 19 based on the installation of the plate member 43 will be described with reference to FIG. 6(A) and FIG. 6(B).

Figure 6A:
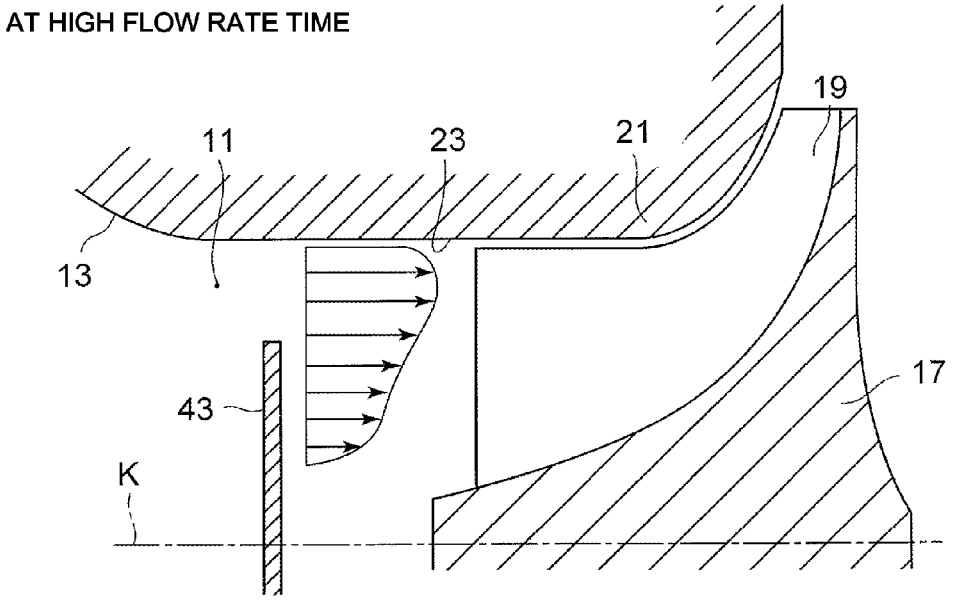
FIG. 6(A) illustrates a distribution at a high flow rate time.
Figure 6B:
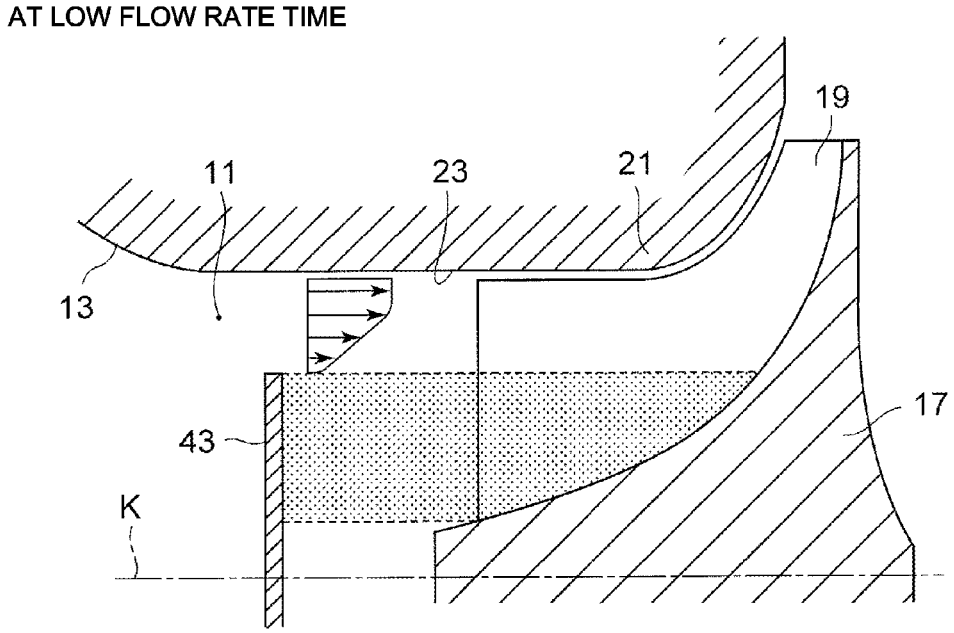
FIG. 6(B) illustrates a distribution at a low distribution rate time.

FIG. 6(A) illustrates a flow velocity distribution at the high flow rate time. At this time, at the entrance of the impeller wheel 7, the air flows from the hub side to the shroud side front end in the blade height direction. Following the decrease in the flow rate, as illustrated in FIG. 2B, the air starts flowing to the shroud side due to the influence of the plate member 43 as the resistive element on the hub side. As compared with the case where there is no resistive element, the inflow velocity of air to the impeller wheel 7 increases, and the surging limit flow rate can be decreased by suppressing the stall of the impeller wheel 7.

As described above, according to the second embodiment, at the high flow rate time, even when the center resistive element 41 exists, the bias of the intake air flow is small as compared with that at the low flow rate time, and the air flows from the hub side to the shroud side front end in the direction of the blade height of the front edge of the vane 19. However, following the decrease in the flow rate, the intake air is biased to the shroud side of the vane 19 by the center resistive element 41, and also the sectional area of the air intake passage 11 is narrowed. As a result, the flow velocity is increased, and the surging limit flow rate can be decreased.

Third Embodiment

Next, a third embodiment will be described with reference to FIG. 8.

In the third embodiment, the plate member 43 in the second embodiment is changed to a rotatable valve element 51.

Figure 8:
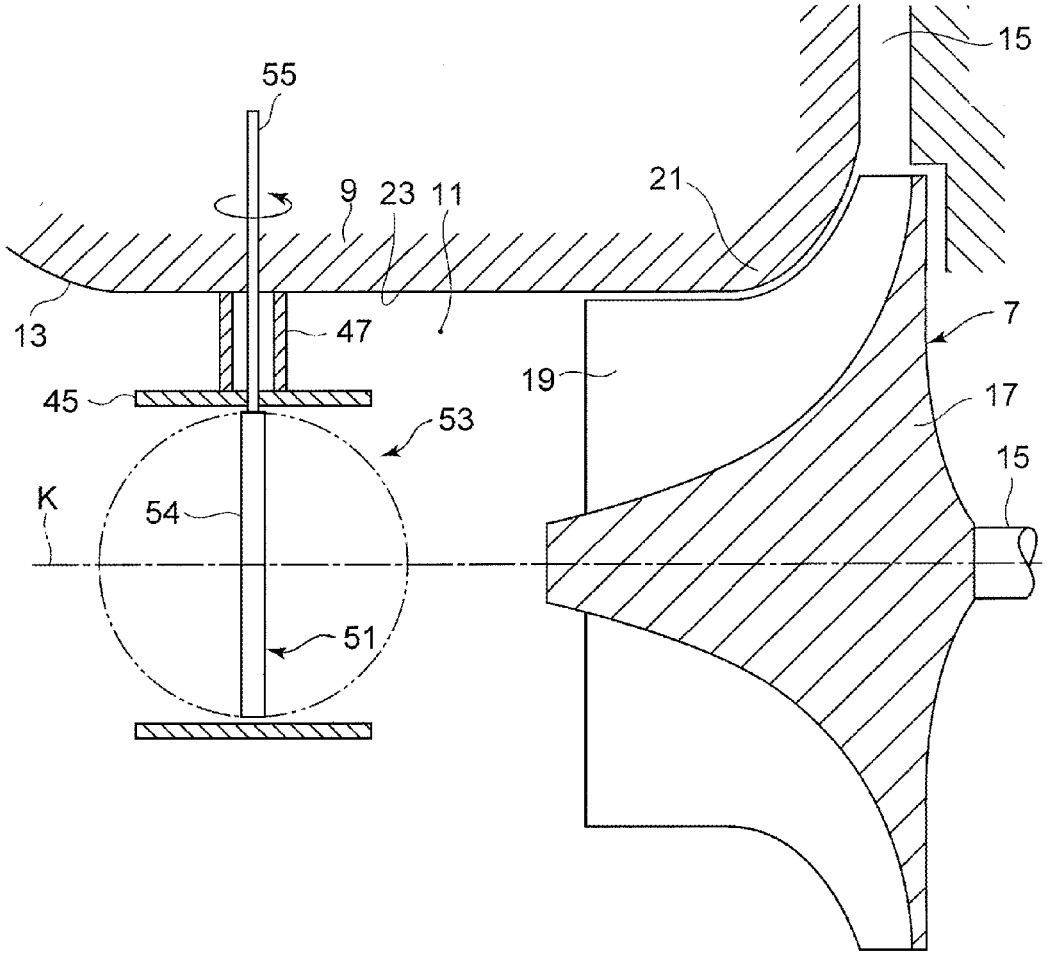
FIG. 8 is a sectional view of a main part in a rotary shaft direction of a centrifugal compressor according to a third embodiment of the present invention.

As illustrated in FIG. 8, a disk-shaped center resistive element 53 is configured by the openable and closable valve element 51 rotating between a total opening along the intake air flow and a total closing, using a radial direction of the air intake passage 11 as a rotational center axis.

A valve element rotary shaft 55 is coupled to the rotary center shaft of the valve element 51, and the valve element rotary shaft 55 pierces through the guide unit 45, and further pierces through the inside of only one strut 47 as an inner piercing structure, or is provided at this portion in place of the one strut 47 and pierces through the compressor housing 9 so as to be protruded to the outer side of the compressor housing 9.

Then, the end part protruded to the outer side by piercing through the compressor housing 9 is rotated by a drive mechanism not illustrated.

The opening and closing operation of the valve element 51 is controlled by a control device such that the valve element 51 becomes in a fully closed state when the valve element 51 reached a predetermined low rotation area, that is, a limit low flow rate area in which surging occurs, based on a rotation velocity of the impeller wheel 7 of the compressor 3.

In the high rotation area, the valve element 51 is closed to a fully opened state to secure a flow rate. In other intermediate area, the valve element 51 is controlled to be closed following a decrease in the flow rate, that is, a decrease in the rotation velocity of the impeller wheel 7.

The plate member 54 constituting the valve element 51 may be configured by an entirely disk-shaped plate member, when the plate member 54 is a resistive element such as a porous unit or a slit resistive element, like in the second embodiment.

In the case of a disk shape, because the aperture of the valve nit 51 is adjusted, the valve element 51 is fully opened at a high flow rate time, and there arises no problem in the point of securing a flow rate. In the case of the valve element 51 configured by a resistive element including a slit-shaped or meshed member, a flow also occurs on the hub side when the valve element 51 is at a fully closed time. Therefore, the flow separation area at the downstream side of the valve element 51 is decreased, and performance improves.

As described above, according to the third embodiment, the openable and closable valve element 51 is provided. On the outer peripheral side of the valve element 51, there is the guide unit 45 in the cylindrical shape or the guide unit 45 in the bell-mouth shape. Following the decrease in the flow rate, the valve element 51 is closed, and the air starts flowing in to the shroud side. As compared with the state that the valve element 51 is opened, the air inflow velocity to the impeller wheel 7 increases, and the surging limit flow rate can be decreased by suppressing the stall of the impeller wheel 7.

Fourth Embodiment

Next, a fourth embodiment will be described with reference to FIG. 9A to FIG. 12.

In the fourth embodiment, there is provided a ring-shaped protruded member 61 protruded in a convex shape to the inner diameter side of the inner peripheral wall 23 of the air intake passage 11.

A resistive element is formed by the ring-shaped protruded member 61. The resistive element includes variable units 64, 66, and 68 for adjusting a protrusion amount of a convex portion 63 of the ring-shaped protruded member 61 protruded to the inner diameter side of the air intake passage 11 according to the inflow air intake amount.

Figure 9A:
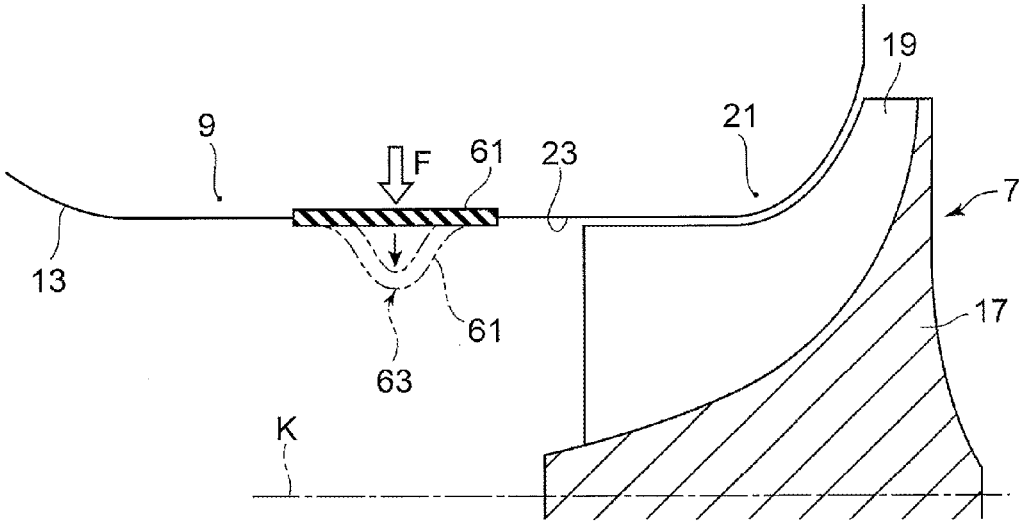
FIG. 9A is a sectional view of a main part in a rotary shaft direction of a centrifugal compressor according to a forth embodiment of the present invention.
Figure 10:
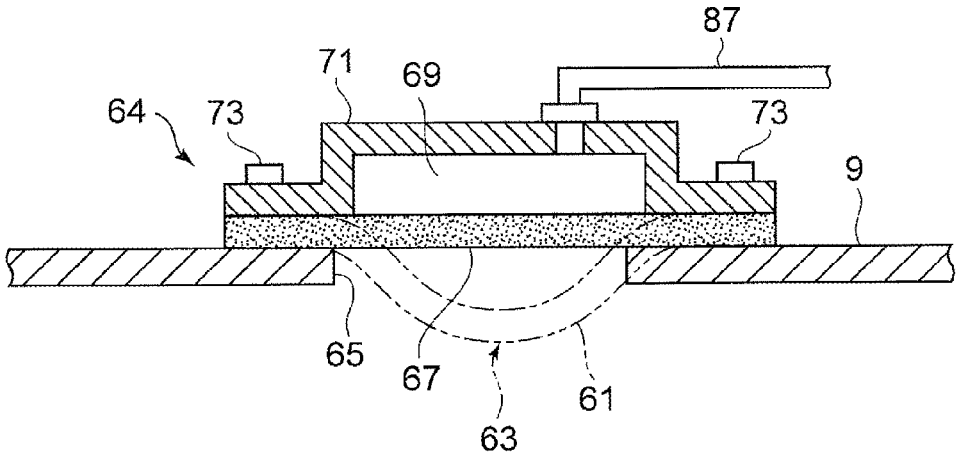
FIG. 10 is a detailed explanatory view of the fourth embodiment.
Figure 11:
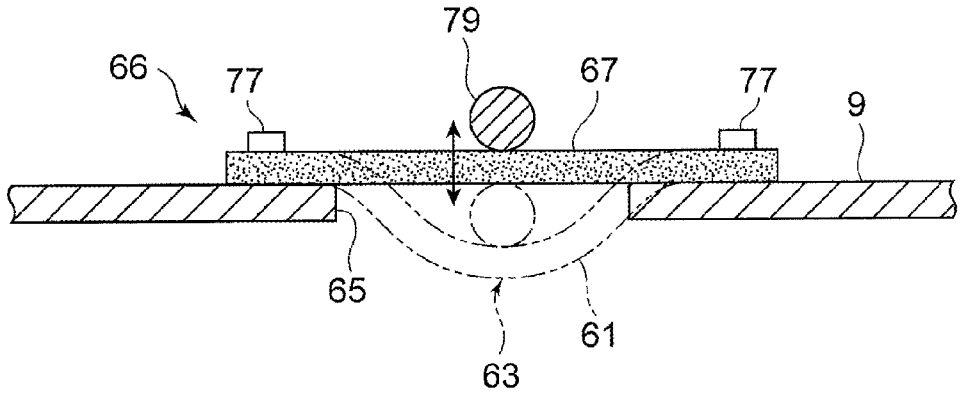
FIG. 11 is an explanatory view illustrating a modification of the fourth embodiment.

FIG. 9A illustrates an outline, and FIGS. 10 and 11 illustrate details.

As illustrated in FIG. 9A, the ring-shaped protruded member 61 formed in convex to the inner diameter side of the inner peripheral wall 23 of the air intake passage 11 is formed by an elastic body (a rubber member or a resin material), and a convex protruded amount is variably controlled by operating a pressing force F from the outer peripheral side to the inner peripheral side.

The variable unit 64 is formed as illustrated in FIG. 10. That is, a ring-shaped slit 65 is formed on the compressor housing 9 side, and a rubber member 67 of an elastic body is arranged in the peripheral direction on the outer side of the slit 65. A pressure chamber housing 71 formed on the outer peripheral side of the rubber member 67 is mounted with bolts 73 so as to form a pressure chamber 69 on the outer side of the rubber member 67. To the pressure chamber 69, a pressure liquid of a pressure air and the like is supplied via a pressure supply pipe 87. Depending on the amount of the pressure liquid supplied to the pressure chamber 69, a protruded amount of the convex portion 63 of the ring-shaped protruded member 61 is controlled.

Further, the variable unit 66 is formed as illustrated in FIG. 11. That is, the ring-shaped slit 65 is formed on the compressor housing 9 side, and the rubber member 67 of an elastic body is arranged in the peripheral direction on the outer side of the slit 65 and are mounted in the peripheral direction with bolts 77.

A fastening band 79 is wound in the peripheral direction on the outer side of the rubber member 67. By variably controlling the fastening force of fastening the fastening band 79, a protruded amount of the convex portion 63 can be controlled.

Figure 9B:
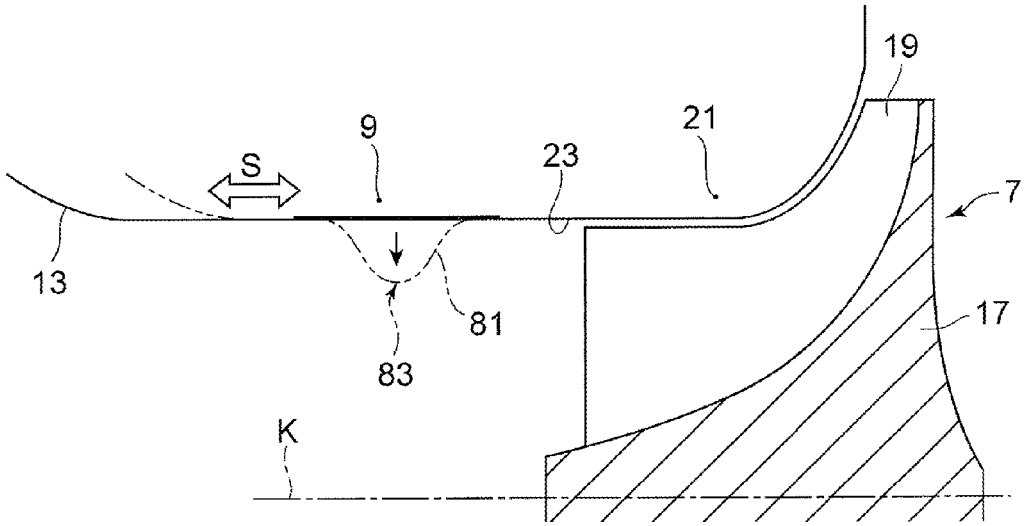
FIG. 9B is a sectional view of a main part in a rotary shaft direction of a centrifugal compressor according to a fifth embodiment of the present invention.
Figure 12:
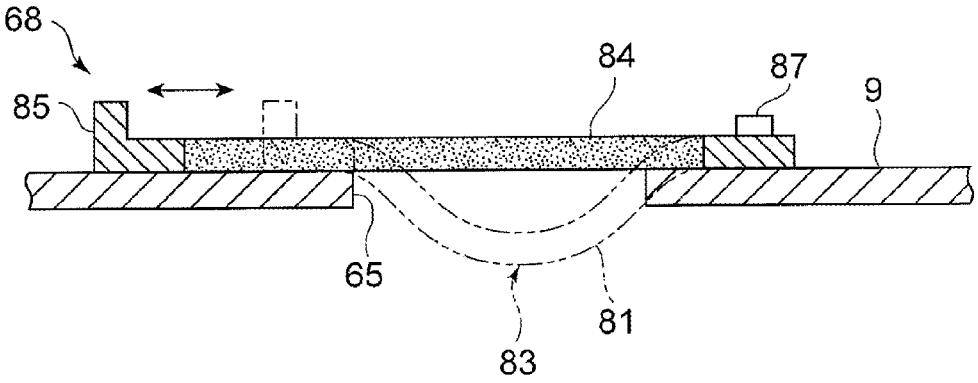
FIG. 12 is an explanatory view illustrating a modification of the fourth embodiment.

Further, as an example of other variable unit 68, FIG. 9B illustrates an outline, and FIG. 12 illustrates details.

As illustrated in FIG. 9B, a ring-shaped protruded member 81 formed in a convex shape on the inner peripheral wall 23 of the air intake passage 11 is formed by an elastic body (a rubber member, or a resin member), and the convex protruded amount is variably controlled.

As illustrated in FIG. 12, there is provided the following structure. The ring-shaped slit 65 is formed on the compressor housing 9 side, and a rubber member 84 of an elastic body is arranged in the peripheral direction on the outer side of the slit 65. On one side in a rotary axis line K direction of the rubber member 84, a slide unit 85 slidable in the rotary axis line K direction is provided. By sliding the slide unit 85 with an actuator not illustrated, a convex portion 83 is protruded to an inner side of the air intake passage 11 so that a ring-shaped protruded member 81 is formed.

A convex protruded amount is controlled according to a slide amount S of the slide unit 85.

As described above, according to the fourth embodiment, the resistive element is formed by the convex ring-shaped protruded members 61 and 81 protruded to the inner diameter side of the inner peripheral wall of the air intake passage 11. By providing the movable units 64, 66, and 68 for adjusting the protruded amount of the convex portions 63 and 83 of the ring-shaped protruded members 61 and 81 to the inner diameter side of the air intake passage 11, the resistive element can be controlled to a protruded amount according to the operation state. Therefore, at the high flow rate time, a flow rate can be secured without protruding, and further in the low flow rate area, surging can be prevented by protruding.

When the flow rate is low, the air flowing in to the vane 19 tends to be mixed with the intake air flow by generating an adverse flow from the front edge 19*a* of the vane 19. Therefore, like in the fourth embodiment, the ring shaped protruded members 81 and 81 convex to the inner diameter side of the inner peripheral wall of the air intake passage 11 also have the work capable of preventing an unstable operation due to a returning flow, by exhibiting the work of stopping the returning flow from the front edge of the vane 19.

Therefore, like in the fourth embodiment, without controlling the convex protruded amount according to the operation state, in the structure of only providing the resistive element by the ring-shaped protruded members 61 and 81 convex to the inner diameter side of the inner peripheral wall 23 of the air intake passage 11, there can be obtained performance improvement in the compressor and the surging limit flow rate decrease effect by the adverse flow prevention effect and the flow rate increase effect described in the first embodiment.

INDUSTRIAL APPLICABILITY

According to the present invention, because the surging limit flow rate at the low flow rate time can be decreased by providing a resistive element that narrows in the radial direction the passage cross section of the air intake passage which communicates between the impeller wheel of the centrifugal compressor and the air intake opening, the resistive element is useful as an application technique to the exhaust turbocharger of the internal combustion engine.

REFERENCE SIGNS LIST

1 Turbocharger
3 Compressor (centrifugal compressor)
5 Rotary shaft
7 Impeller wheel
9 Compressor housing (housing)
11 Air intake passage
13 Air Intake opening
17 Hub
19 Vane (blade)
23 Inner peripheral wall
25 Inner peripheral resistive element (resistive element)
27, 43 Plate member (resistive element)
29, 45 Guide unit
31 Bell-mouth guide unit
41 Center resistive element (resistive element)
47 Strut
51 Valve element
61, 81 Ring-shaped protruded member
64, 66, 68 Variable unit
67, 84 Rubber member

The invention claimed is:

1. A centrifugal compressor comprising;

a housing having an air intake opening opened in a rotary shaft direction and an air intake passage continuous to the air intake opening, an impeller wheel having a plurality of blades and rotationally disposed centered around the rotary shaft inside the housing and compressing intake air flowing in from the air intake opening, a guide unit formed in one of a cylindrical shape, a hollow truncated cone shape, or a bell-mouse shape extending in an axial direction of the air intake passage in which a flow path on an inflow side is wide and a flow path on an outflow side is narrowed, a center resistive element provided on the inner side of the guide unit and formed in a disk shape, and at least one strut mounting the guide unit on the inner peripheral wall of the air intake passage, wherein the disk-shaped center resistive element comprises an openable and closable valve element rotating between a totally opened position along an intake air flow and a totally closed position interrupting the intake air flow, said disk-shaped element being rotatable about an axis that extends in a radial direction of the air intake passage, and wherein the valve element is a fluid resistive element comprising one of a porous plate or a mesh member whereby a flow occurs through said valve member at a hub side of the impeller wheel even when said valve member is fully closed.

2. The centrifugal compressor according to claim 1, wherein the valve element is controlled to be set to a total opening state when an intake air flow rate is equal to or higher than a predetermined flow rate, and is controlled to be closed following a reduction in the flow rate.

3. The centrifugal compressor according to claim 1, further comprising a valve element rotary shaft coupled to the rotational center axis, the valve element rotary shaft piercing through an inside of the at least one strut.

* * * * *